US010563607B2

(12) United States Patent
De Cesare et al.

(10) Patent No.: US 10,563,607 B2
(45) Date of Patent: Feb. 18, 2020

(54) METHOD TO CONTROL AN ELECTROMECHANICAL LINEAR ACTUATOR DEVICE FOR AN INTERNAL COMBUSTION ENGINE

(71) Applicant: MAGNETI MARELLI S.p.A., Corbetta (IT)

(72) Inventors: Matteo De Cesare, Torremaggiore (IT); Enrico Brugnoni, Perugia (IT); Nicola Torcolini, Bologna (IT); Federico Monti, Bologna (IT)

(73) Assignee: MAGNETI MARELLI S.p.A., Corbetta (IT)

( * ) Notice: Subject to any disclaimer, the term of this patent is extended or adjusted under 35 U.S.C. 154(b) by 0 days.

(21) Appl. No.: 15/975,357

(22) Filed: May 9, 2018

(65) Prior Publication Data

US 2018/0328303 A1 Nov. 15, 2018

(30) Foreign Application Priority Data

May 10, 2017 (IT) ..... 102017000050454

(51) Int. Cl.
*F02D 41/24* (2006.01)
*F02M 37/04* (2006.01)
(Continued)

(52) U.S. Cl.
CPC ..... *F02D 41/2464* (2013.01); *F02M 37/043* (2013.01); *F02M 37/08* (2013.01);
(Continued)

(58) Field of Classification Search
CPC ..... F02D 41/2467; F02D 2041/2037; F02D 2041/2051; F02D 2200/025; F02M 37/043; F02M 37/08; H01F 2007/1894
(Continued)

(56) References Cited

U.S. PATENT DOCUMENTS 5,797,360 A * 8/1998 Pischinger ..... F01L 9/04 123/90.11
6,176,208 B1 * 1/2001 Tsuzuki ..... F01L 1/462 123/90.11
(Continued)

FOREIGN PATENT DOCUMENTS

DE 112015002295 T5 2/2017
EP 2180178 A1 4/2010
(Continued)

OTHER PUBLICATIONS

Search Report for Italian Patent Application No. 201700050454 dated Jan. 12, 2018.

*Primary Examiner* — Erick R Solis
(74) *Attorney, Agent, or Firm* — Howard & Howard Attorneys PLLC

(57) ABSTRACT

A method is described to control an actuation profile of an electromechanical linear actuator device of an internal combustion engine designed to control the movement of a component; the internal combustion engine comprises a sensor, which faces the actuator device and is designed to detect the noise generated by the movement of the component; the method comprises the steps of acquiring, by means of the sensor, the intensity of a signal generated by the impact of the component against a limit stop; identifying a first listening window of the signal associated with said impact; calculating a noise index inside the listening window; comparing the noise index with a reference value; and controlling the actuation profile of the actuator device based on this comparison.

12 Claims, 4 Drawing Sheets

(51) Int. Cl.
*F02M 37/08* (2006.01)
*F04B 49/06* (2006.01)
*F02D 41/22* (2006.01)

(52) U.S. Cl.
CPC ..... *F04B 49/065* (2013.01); *F02D 41/221* (2013.01); *F02D 2041/224* (2013.01)

(58) Field of Classification Search
USPC ..... 123/497, 499
See application file for complete search history.

(56) References Cited

U.S. PATENT DOCUMENTS

| | | | | |
|---|---|---|---|---|
| 6,298,827 | B1 | 10/2001 | Desai et al. | |
| 6,349,685 | B1 * | 2/2002 | Kolmanovsky | F01L 9/04 123/90.11 |
| 7,089,895 | B2 * | 8/2006 | Naber | F01L 9/04 123/90.11 |
| 7,092,812 | B2 * | 8/2006 | Panciroli | F01L 9/02 701/101 |
| 7,753,657 | B2 * | 7/2010 | Strauss | F02D 41/20 123/497 |
| 9,212,611 | B2 * | 12/2015 | Panciroli | F02D 35/02 |
| 2007/0114481 | A1 * | 5/2007 | Suyama | F16K 31/06 251/129.15 |
| 2010/0139624 | A1 | 6/2010 | Surnilla et al. | |
| 2017/0082099 | A1 | 3/2017 | Takagawa et al. | |

FOREIGN PATENT DOCUMENTS

| | | | |
|---|---|---|---|
| EP | 2554825 | A2 | 2/2013 |
| EP | 2899387 | A1 | 7/2015 |

* cited by examiner

METHOD TO CONTROL AN ELECTROMECHANICAL LINEAR ACTUATOR DEVICE FOR AN INTERNAL COMBUSTION ENGINE

PRIORITY CLAIM

This application claims priority from Italian Patent Application No. 102017000050454 filed on May 10, 2017, the disclosure of which is incorporated by reference.

TECHNICAL FIELD

The invention relates to a method to control an electromechanical linear actuator device for an internal combustion engine.

PRIOR ART

The invention finds advantageous application in the field of internal combustion engines, where an internal combustion engine is known, which comprises at least one cylinder connected to an intake manifold by means of at least one intake valve and to an exhaust manifold by means of at least one exhaust valve.

The intake manifold feeds air coming from the outside into the cylinder, whereas the exhaust manifold lets out of the cylinder the gases produced by the combustion, so as to feed them to a silencer and, hence, into the atmosphere.

The fuel is fed to the cylinder by means of an electronic-injection feeding system comprising an injector, which is arranged close to the intake valve so as to inject the fuel into the intake manifold or is arranged so as to directly inject the fuel into the cylinder.

The feeding system comprises, furthermore, a fuel pump, which draws the fuel from a containing tank at atmospheric pressure and feeds it to the injector under the control of an electronic control unit, which controls the injector so as to cyclically inject the fuel during the intake phases of the cylinder and, furthermore, controls the fuel pump so as to feed the fuel to the injector at a constant pressure.

Generally speaking, the fuel pump comprises a tubular pump body defining a feeding channel connected, on one side, to the fuel containing tank and, on the opposite side, to the injector.

The feeding channel is engaged in a sliding manner by a piston defining, inside the pump body, a pumping chamber with a variable volume, which is connected to the injector through the interposition of a non-return valve and is further connected to the feeding channel by means of at least one opening, which is obtained through the piston and usually is closed by a reed valve, which is fixed to the piston.

The piston is movable along a feeding channel with a straight reciprocating motion due to the thrust of an operating device comprising an electromagnetic actuator, which is designed to move the piston with a an intake stroke forcing fuel into the pump body, and a spring, which is designed to move the piston with a delivery stroke delivering fuel to the injector.

The fuel pump comprises, furthermore, a first limit stop organ to stop the piston at the end of the intake stroke and a second limit stop organ to stop the piston at the end of the delivery stroke.

Fuel feeding pumps of the type described above are affected by some drawbacks, which are mainly due to the fact that these pumps produce a relatively high noise deriving from the impact of the piston both against the first limit stop organ and against the second limit stop organ. In particular, the fuel pump described produces, in use, a clearly perceivable noise, in particular when the engine runs slow (namely, when the overall noise generated by the engine is moderate).

In order to reduce this noise, one could act, via software, upon the intensity and the waveform of the control current of the actuator device, so as to minimize the kinetic energy of the piston when it hits first and the second limit stop organ. In order to significantly reduce the kinetic energy of the piston at the moment of the impact, the control system must excite an electromagnet of the electromagnetic actuator with a control current that is as close as possible to the "limit" control current (which gives to the piston the "minimum" kinetic energy at the moment of the impact), but, especially, the control system must excite the electromagnet with a control current that is never below the "limit" control current, otherwise the actuation is lost (namely, the piston never reaches the desired position due to an insufficient kinetic energy). The value of the "limit" control current is extremely variable from case to case due to constructive losses and to creeps caused by time and temperature; furthermore, it is not always possible to check whether the limit position has been reached (namely, whether the actuation has been completed) and, therefore, the control system must completely act in open loop, thus becoming definitely ineffective in the limitation of the impact kinetic energy and, hence, in the limitation of the noise.

Methods have been suggested to control an actuation profile of an actuator device of a high-pressure fuel pump for an internal combustion engine provided with a sensor arranged close to the actuator device and designed to detect the noise generated by the movement of the piston. The method involves acquiring, by means of the sensor, the intensity of a signal generated by the impact of the sensor against a limit stop; and changing the times of the actuation profile of the actuator device based on the comparison between the intensity of the signal generated by the impact of the piston against a limit stop and a reference value. Methods to control an actuator device for an internal combustion engine of the type described above are known, for example, from documents EP2899387, US2010139624, U.S. Pat. No. 6,298,827 and DE112015002295.

However, the methods described above do not effectively reduce the noise generated by the impact of the piston at the end both of the delivery stroke and of the intake stroke and do not allow users to diagnose a possible fault of the actuator device.

DESCRIPTION OF THE INVENTION

An object of the invention is to provide a method to control an electromechanical linear actuator device for an internal combustion engine, said method being free from the drawbacks described above and, at the same time, easy and cheap to be implemented.

According to the invention, there is provided a method to control an electromechanical linear actuator device for an internal combustion engine according to the appended claims.

BRIEF DESCRIPTION OF THE DRAWINGS

The invention will now be described with reference to the accompanying drawings, which show a non-limiting embodiment thereof, wherein.

PREFERRED EMBODIMENTS OF THE INVENTION

Figure 1:
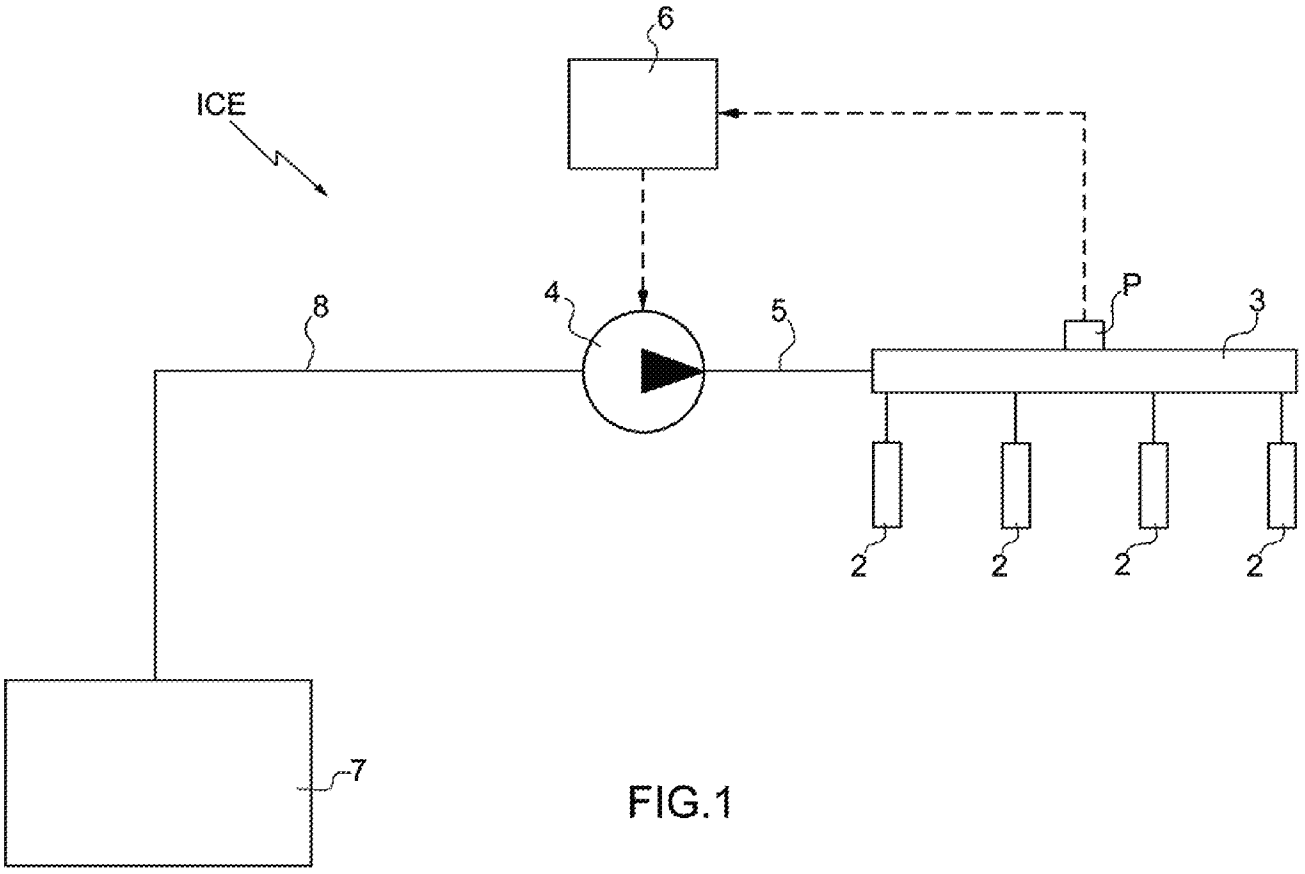
FIG. 1 is a schematic view, with some details removed for greater clarity, of a fuel injection system.

In FIG. 1, number 1 indicates, as a whole, a fuel injection system, in particular using gasoline as a fuel, for an internal combustion engine (ICE).

The injector system 1 comprises a plurality of injectors 2, a channel 3, which feeds fuel under pressure to the injectors 2, a pump 4, which feeds fuel from a tank 7, by means of a feeding duct 8, to the common rail 3, by means of a feeding duct 5, a control unit 6, which controls the pump 4 with a frequency that generally is variable in time depending on the operating conditions of the internal combustion heat engine (ICE).

Figure 2:
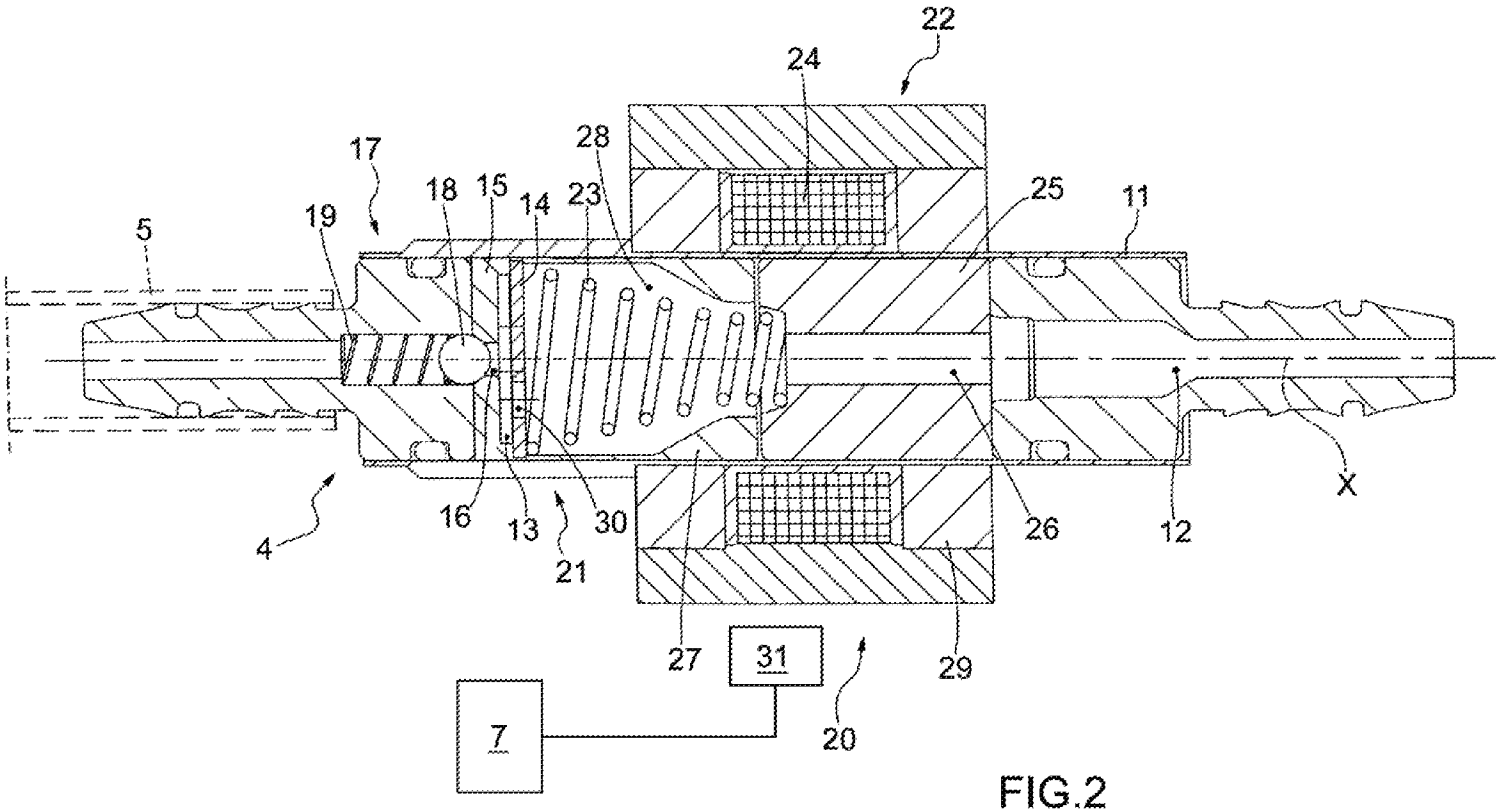
FIG. 2 shows an electromechanical actuator of the present invention.

According to FIG. 2, the fuel pump 4 comprises a tubular cylindrical housing body 11 having a central feeding channel 12, which is provided with an axis X and is connected, on one side, to the fuel tank 7 by means of the feeding duct 8 and, on the opposite side, to the common rail 3 by means of the feeding duct 5.

Inside the housing body 11 and along the feeding channel 12 there is defined a variable-volume pumping chamber 13, which has a cylindrical shape, is laterally delimited by the housing body 11, and is axially delimited by a movable piston 14 and by a fixed closing disc 15, which has a delivery through hole 16 engaged by a one-way delivery valve 17, which adjusts the outlet of fuel from the pumping chamber 13. Preferably, the delivery valve 17 is a ball valve and comprises a ball shutter 15, which is pushed against a mouth of the delivery hole 16 by a valve spring 19.

The piston 14 is operated by an actuator device 20, which, in use, causes a reciprocating motion of the piston 14 so as to cyclically vary the volume of the pumping chamber 13. The piston 14 integrates, on the inside, a one-way intake valve 21, which adjusts the feeding of fuel to the pumping chamber 13.

The actuator device 20 comprises an electromagnetic actuator 22 to operate the piston 14 during an intake phase and a spring 23 to operate the piston 14 during a delivery phase.

In other words, during the intake phase, the electromagnetic actuator 22 is energized in order to move the piston 14 towards a first limit stop position, thus increasing the volume of the pumping chamber 13, and against the force exerted by the spring 23; at the end of the intake phase, the electromagnetic actuator 22 is de-energized and the piston 14 is moved in a second direction, which is contrary to the first direction, thus reducing the volume of the pumping chamber 13, by the elastic force exerted by the spring 23 until it reaches a second limit stop position.

According to a preferred embodiment, the spring 23 is sized so that the pre-load force exerted by the spring 23 itself upon the piston 14 is equal to the usable area of the piston 14 (i.e. the circular surface of the piston 14 delimiting the pumping chamber 13) multiplied by the desired fuel feeding pressure. By so doing, the spring 23 is capable of pushing fuel out of the pumping chamber 13 through the delivery valve 17 and towards the feeding duct 5 leading into the common rail 3, only if the fuel pressure inside the feeding duct 5 is smaller than the desired fuel feeding pressure; otherwise the system is balanced, namely the thrust exerted by the spring 23 upon the fuel present in the pumping chamber 13 is equal to the opposite thrust exerted by the fuel present in the feeding duct 5, hence the delivery valve 17 does not open and the piston 14 remains still. It should be pointed out that sizing of the spring 23 discussed above does not take into account the contribution of the valve spring 19, as the elastic force exerted by the valve spring 19 is much smaller than the elastic force exerted by the spring 23.

The electromagnetic actuator 22 comprises a coil 24, a fixed mechanical abutment 25, obtained inside the housing body 11 and having a central hole 26 to allow fuel to flow along the feeding channel 12, and a movable armature 27, which is arranged inside the housing body 11, has a central hole 28 to allow fuel to flow along the feeding channel 12, is rigidly connected to the piston 14, and is designed to be magnetically attracted by the magnetic pole 25 when the coil 24 is energized.

The mechanical abutment can be any physical object fulfilling the function of stopping the movement of the movable armature 27 at a predetermined height. According to a preferred variant, the mechanical abutment is obtained with a fixed magnetic pole 25 arranged inside the housing body 11.

According to a preferred embodiment, the coil 24 is arranged externally around the housing body 11 and, therefore, is isolated from the fuel.

Furthermore, the electromagnetic actuator 22 comprises a tubular magnetic armature 29, which is arranged on the outside of the housing body 11 and comprises a seat to accommodate, on the inside, the coil 24.

Preferably, the spring 23 is arranged inside the central hole 28 of the movable armature 27 and is compressed between the fixed magnetic pole 25 and the piston 14. Furthermore, the spring 23 preferably has a conical shape having the larger base in the area of the piston 14, so as to simplify the installation of the spring 23 itself.

According to a preferred variant, the piston 14 consists of a plate with a small thickness and is provided with a plurality of feeding through holes 30. The piston 14 is movable along the axis X between two extreme limit stop positions. The first limit stop position is reached at the end of the intake stroke, when the movable armature 27 hits the mechanical abutment. On the other hand, the second limit stop position is reached at the end of the delivery phase, when the piston 14 hits the fixed closing disc 15.

During the normal operation of the injection system 1, the control unit 6 controls the actuator device 20 of the fuel pump 4 with a command depending on the engine point and in a synchronized manner with the commands of the injectors 2. It should be pointed out that, when the engine runs slow, the injection frequency (i.e. the frequency at which the injector 2 is controlled) is low (even 1/10 of the injection frequency at peak rpm) and, as a consequence, the controlling frequency of the actuator device 20 of the fuel pump 4 is low as well and, therefore, the power consumption of the actuator device 20 is low.

Figure 3:
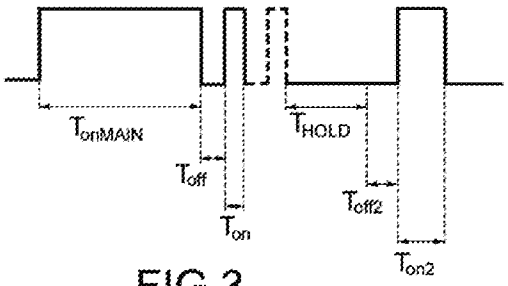
FIG. 3 shows the actuation profile of an electromechanical linear actuator of FIG. 2.

The actuator device 20 is controlled by the control unit 6 and is powered following a power profile and, in particular, according to FIG. 3, the actuator device 20 is powered with a voltage profile identified by the following time quantities:

$T_{ON\text{-}MAIN}$ time needed to reach the maximum value of the current absorbed by the actuator device 20;

$T_{ON}$, $T_{OFF}$ duration of the current pulses that are repeated;

$T_{HOLD}$ time during which the supply voltage is equal to zero and the current absorbed by the actuator device 20 decreases;

$T_{ON2}$, $T_{OFF2}$ duration of the current pulses when the goal is that of reducing the speed of the movable equipment (i.e. of the piston 14 and of the armature 27) towards the second limit stop position.

The actuator device 20 is further provided with a microphone sensor 31 facing the actuator device 20 and/or with a vibration sensor 31 integrated in the body of the actuator device 20 and/or with a vibration sensor 31 arranged externally on the body of the actuator device 20. Hereinafter we will use the generic term sensor 31 to indicate any one of the sensors 31 described above or any combination thereof.

Figure 4:
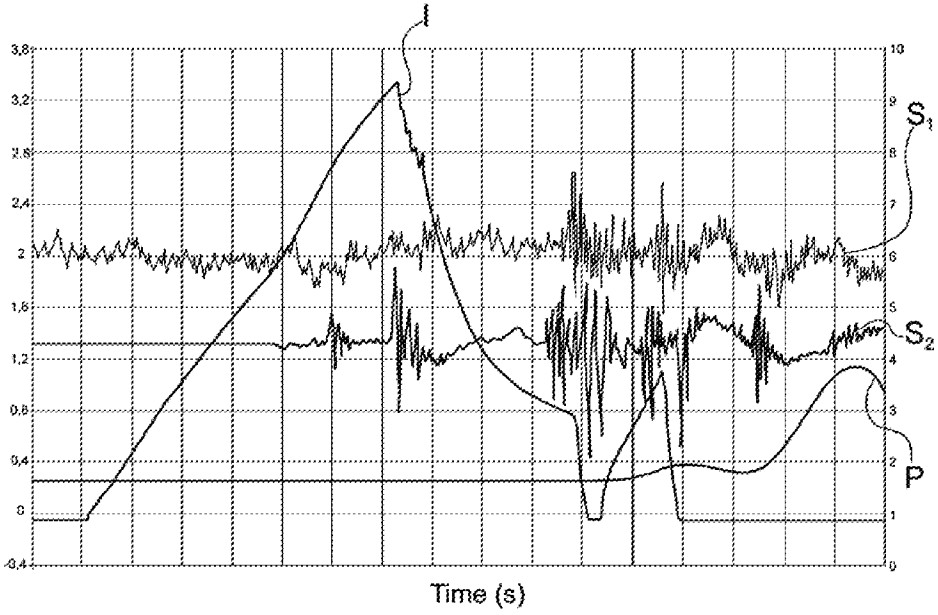
FIG. 4 shows the development of the signals detected by a number of sensors during an actuation cycle of an actuator device of FIG. 2.

An actuation profile under voltage of the type shown in FIG. 3 typically generates, for a pressure value of zero bars, a current profile of the type shown in FIG. 4, wherein I indicates the development of the current absorbed by the actuator device 20, $S_1$ indicates the microphone signal detected by a sound sensor 31 facing the actuator device 20, $S_2$ indicates the accelerometer signal detected by the vibration sensor 31 fitted on the outside of the actuator device 20 and P indicates the signal detected by the pressure sensor P. Both the development of the signal $S_1$ and the development of the signal $S_2$ show a significant variability upon reaching the first limit stop position and the second limit stop position. Experiments have shown that, as the pressure increases, the noise produced upon reaching the second limit stop position decreases, whereas the noise produced upon reaching the first limit stop position remains substantially constant.

Hereinafter is a description of the method to control the actuator device 20 implemented by the control unit 6 in order to reduce the noise produced.

First of all, the method involves reducing the noise produced upon reaching the first limit stop position.

The control unit 6 is configured to acquire the signal coming from the sensor 31 arranged close to the actuator device 20. The signal coming from the sensor 31 arranged close to the actuator device 20 is rich in information, but it can hardly be correlated with the intake phase of the actuator device 20.

Figure 5:
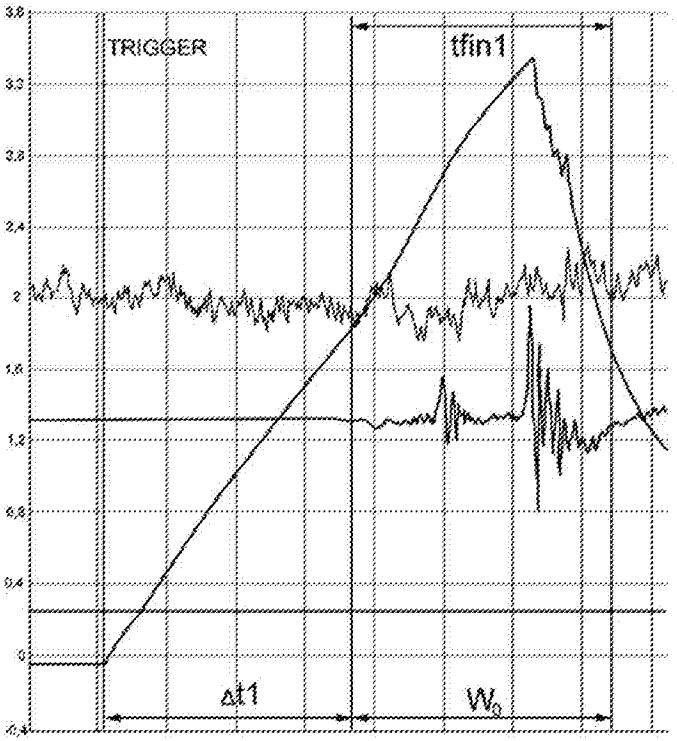

According to FIG. 5, in order to obtain the information needed, a signal listening window $W_O$ is identified, which can be associated with the intake phase of the actuator device 20.

In order to determine the position of the listening window $W_O$, it is necessary to take into account the instant in which the voltage command of the intake phase of the actuator device 20 is started; this instant, indeed, is known to the control unit 6.

After a time interval with a duration equal to $\Delta t_1$ has elapsed since the instant in which the voltage command of the intake phase of the actuator device 20 was started, the signal coming from the sensor 31 is detected and analysed for a time interval with a duration equal to $T_{fin1}$. Both the duration of the time interval $\Delta t_1$ and the duration of the time interval $T_{fin1}$ are determined in a preliminary phase and are variable depending on the type of application for the actuator device 20. In case the first limit stop position is reached, it is sufficient to determine one single signal listening window $W_O$, as the control unit 6, which knows the instant in which the voltage command of the actuator device 20 is started, can determine with an acceptable degree of approximation when the first limit stop position is reached.

The signal detected in the listening window $W_O$ is treated with a band-pass filter, which leads to an analysis of the sole part of the signal that is the richest in information. For example, the filtering interval is defined between 5 and 15 kHz.

According to a possible variant, the method steps described above are reversed. In other words, the signal detected by the sensor 31, at first, is treated with a band-pass filtering in order to analyse the sole part of the signal that is the richest in information coming from the actuator device 20 and eliminate the components that can disturb the signal generated by the actuator device 20, and subsequently the signal is identified and analysed inside an associable signal listening window $W_O$ upon reaching the first limit stop position.

According to a further variant, in order to obtain information from the signal coming from the sensor 31 arranged close to the actuator device 20, instead of the aforesaid band-pass filtering, it is possible to operate a fast Fourier transform—FTT so as to break the obtained signal out into a sum of harmonics with different frequencies, amplitudes and phases.

The signal taken into account inside the listening window $W_O$ is then processed by the control unit 6 in order to obtain a noise index IDRC.

According to a first variant, the noise index IDRC is calculated according to the following formula:

$$\mathrm{IDRC}=\mathrm{MAXs}(t)_{t2}^{t1}-\mathrm{MINs}(t)_{t2}^{t1} \quad [1]$$

IDRC noise index in the listening window $W_O$;

s(t) filtered signal detected by the sensor 31;

$t_1$, $t_2$ time instants defining the listening window $W_O$ with a duration equal to $T_{fin1}$.

According to a second variant, the noise index IDRC is calculated according to the following formula:

$$IDRC = \frac{1}{N}\sum_{t=t_1}^{t_N} \left|\hat{S}(t)\right| \quad [2]$$

IDRC noise index in the listening window $W_O$;

$\hat{S}(t)$ signal filtered in time;

$t_1$, $t_N$ time instants defining the listening window $W_O$ with a duration equal to $T_{fin1}$.

According to a third variant, the noise index IDRC is calculated according to the following formula:

$$IDRC = \underset{f_0 \le f \le f_1}{\mathrm{MAX}} \left|\hat{S}(f)\right| \quad [3]$$

IDRC noise index in the listening window $W_O$;

$\hat{S}(f)$ signal processed by operating a fast Fourier transform;

$f_0$, $f_1$ ends of the band of frequencies analysed in the signal processed by operating a fast Fourier transform inside the listening window $W_O$ with a duration equal to $T_{fin1}$. According to a fourth variant, the noise index IDRC is calculated according to the following formula:

$$IDRC = \frac{1}{N}\sum_{f=f_1}^{f_N} |\hat{S}(f)| \quad [4]$$

IDRC noise index in the listening window $W_O$;

$\hat{S}(f)$ signal processed by operating a fast Fourier transform;

$f_1$, $f_N$ ends of the band of frequencies analysed in the signal processed by operating a fast Fourier transform inside the listening window $W_O$ with a duration equal to $T_{fin1}$.

The noise index IDRC calculated for the listening window $W_O$ is then compared with a reference value $I_{REF}$ determined based on the actuator device 20 and on the type of application.

Depending on the comparison between the calculated noise index IDRC and the reference value $I_{REF}$, the control unit 6 is suited to control the actuator device 20 so as to reduce the noise generated.

In particular, the following two conditions can occur:

the noise index IDRC calculated for the listening window $W_O$ exceeds the reference value $I_{REF}$; in this case, the time $T_{ON\text{-}MAIN}$ needed to reach the maximum value of the current absorbed by the actuator device 20 is decreased by a value equal to $\Delta t_2$;

the noise index IDRC calculated for the listening window $W_O$ is smaller than the reference value $I_{REF}$; in this case, the time $T_{ON\text{-}MAIN}$ needed to reach the maximum value of the current absorbed by the actuator device 20 is increased by a value equal to $\Delta t_3$.

The above-mentioned correction of the time $T_{ON\text{-}MAIN}$ needed to reach the maximum value of the current absorbed by the actuator device is interrupted in case the difference in absolute value between the noise index calculated for the listening window $W_O$ and the reference value $I_{REF}$ is smaller than a limit value TV, which preferably is constant and is determined in a preliminary set-up phase.

The values $\Delta t_2$ and $\Delta t_3$ are determined in a preliminary set-up phase and can be equal to one another or not depending on the actuator device 20 and on the type of application.

Figure 6:
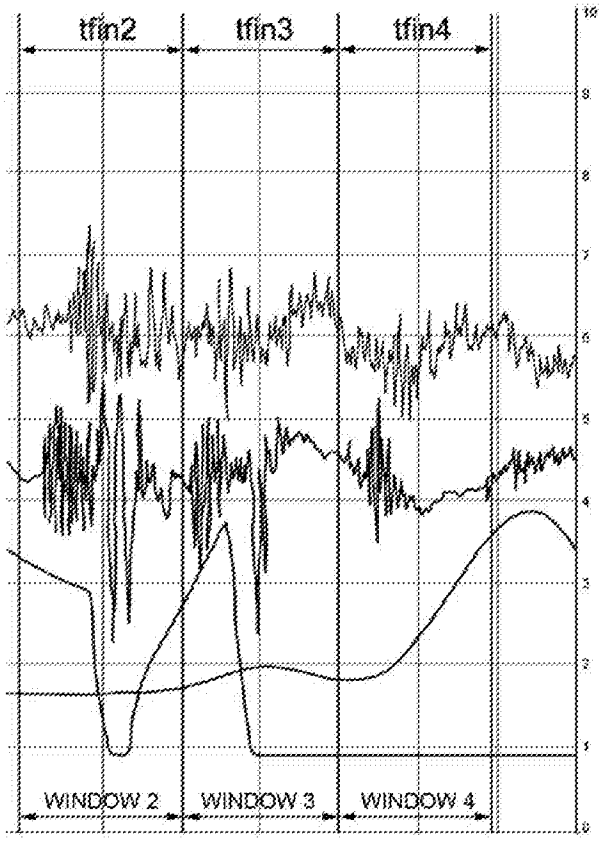
FIGS. 5 and 6 show the development of the signals detected by a number of sensors during an actuation cycle of an actuator device of FIG. 2 and divided into time intervals according to the invention.

On the other hand, as far as the control of the noise generated upon reaching the second limit stop position is concerned, according to FIG. 6, the method involves dividing the signal detected by the sensor 31 into a plurality of listening windows CWi; the respective noise index $IDRC_1$, . . . $IDRC_N$ is calculated for each one of said listening windows CWi according to one of the formulas from [1] to [4] described above.

The detected signal preferably is divided into a plurality of listening windows CWi because the fact of reaching the second limit stop position depends on different factors, such as delivery pressure, mechanical features of the actuator device 20, electromagnetic features of the actuator device 20, mechanical wear, etc.; therefore, the reaching of the second limit stop position cannot be identified with one single listening window, contrary to what happens with the reaching of the first limit stop position.

Among all the noise indexes $IDRC_1$, $IDRC_N$ obtained, it is possible to identify the maximum value $IDRC_{MAX}$ that indicates the listening window $CW_i$ where the second limit stop position is reached. The maximum value $IDRC_{MAX}$ of the noise index permits the recognition of the listening window $CW_i$ where the second limit stop position is reached.

The maximum value $IDRC_{MAX}$ identifying the listening window $CW_i$ where the second limit stop position is reached is then compared with a reference value IDRR, which is determined in a preliminary set-up phase based on the actuator device 20 and on the type of application.

Depending on the result of the comparison between the maximum value $IDRC_{MAX}$ and the reference value IDRR, the control unit 6 is suited to control the actuator device 20 so as to reduce the noise generated.

In particular, the following two conditions can occur:

the maximum value $IDRC_{MAX}$ is smaller than the reference value IDRR; in this case there is no intervention;

the maximum value $IDRC_{MAX}$ exceeds the reference value IDRR; in this case it is necessary to identify the listening window $CW_i$ where the second limit stop position characterized by the maximum value $IDRC_{MAX}$ is reached.

The control unit 7 is configured to compare the time position of the listening window $CW_i$ of interest (i.e. the listening window $CW_i$ characterized by the maximum value $IDRC_{MAX}$) with the instant in which the closing slowing-down command starts, so as to control the actuator device 20 in order to reduce the noise generated upon reaching the second limit stop position.

Again, the following two conditions can occur:

the listening window $CW_i$ of interest precedes the closing slowing-down command; in this case, the time $T_{OFF2}$ is increased by a value equal to $\Delta t$;

the listening window CWi of interest follows the closing slowing-down command; in this case, the time $T_{OFF2}$ is decreased by a value equal to $\Delta t$.

The closing slowing-down command is represented by the control of the actuator device 20 designed to reduce the speed of impact of the movable equipment upon reaching the second limit stop position.

The value $\Delta t$ is determined in a preliminary set-up phase depending on the actuator device 20 and on the type of application and it preferably is constant.

The noise index IDRC can be used both to reduce the noise generated upon reaching the first limit stop position and/or the second limit stop position and to diagnose a fault of the actuator device 20.

In particular, as far as the reaching of the first limit stop position is concerned, the control unit 6 is suited to recognize a fault of the actuator device 20 in case the time $T_{ON\text{-}MAIN}$ needed to reach the maximum absorbed current value is increased by a value equal to $\Delta t_3$ for a given number $n_1$ of actuation cycles. In other words, in case the time $T_{ON\text{-}MAIN}$ needed to reach the maximum absorbed current value is saturated to a maximum value $T_{ON\text{-}MAINmax}$, this means that no noise was generated and, therefore, that the actuator device 20 does not correctly control the movement of the movable equipment (namely, the movement of the piston 14 and of the armature 27) towards the first limit stop position.

Similarly, as far as the reaching of the second limit stop position is concerned, the control unit 6 is suited to recognize a fault of the actuator device 20 in case the maximum value $IDRC_{MAX}$ is smaller than the reference value IDRR for a given number $n_2$ of actuation cycles. In particular, in case the difference between the maximum value $IDRC_{MAX}$ and the reference value IDRR exceeds a tolerance value LV for a given number $n_2$ of actuation cycles, this means that no noise was generated and, therefore, that the actuator device 20 does not correctly control the movement of the movable equipment (namely, the movement of the piston 14 and of the armature 27) towards the second limit stop position.

Clearly, the above-mentioned steps to diagnose a fault of the actuator device 20 can be carried out only after having checked the correct operation of the control unit 6 and the wiring connecting the actuator device 20 to the control unit 6. In other words, possible faults of the control unit 7 and of the wiring connecting the actuator device 20 to the control unit 6 must be excluded before being capable of diagnosing a fault of the actuator device 20.

In the description above we made explicit reference to the case of an actuator device 20 used in a fuel pump 4 of an injection system, but it is evident that the description above can find advantageous application in any actuator device 20.

In particular, the description above can advantageously apply to an electromechanical linear actuator device 20 for the actuation of oil and water pumps and/or compressors and/or hydraulic and pneumatic valves and/or intake and discharge systems with a variable geometry.

The control method described above leads to some advantages; in particular, it allows the produced noise to be effectively reduced, is easy and cheap to be implemented (it does not require additional components besides a standard sensor 31 and does not involve an excessive computing burden for the control unit 6) and, finally, permits the recognition of possible faults occurred to the actuator device 20.

The invention claimed is:

1. A method to control an actuation profile of an electromechanical linear actuator device (20) for an internal combustion engine (ICE); wherein the actuator device (20) is designed to control the movement of a movable armature (27) moving towards a first limit stop position defined by a fixed mechanical abutment (25) and vice versa; the internal combustion engine (ICE) comprises a sensor (31), which is arranged close to the actuator device (20) and is designed to detect the noise generated by the movement of the movable armature (27); the method comprises the steps of:

acquiring, by means of the sensor (31), the intensity of a signal (S) generated by the impact of the movable armature (27) against the fixed mechanical abutment (25);

identifying a first listening window (OW) in the signal (S) detected by the sensor (31); wherein the first listening window (OW) identifies the impact of the movable armature (27) against the fixed mechanical abutment (25);

calculating a first noise index (IDRC) of the signal (S) detected by the sensor (31) inside the first listening window (OW);

comparing the first noise index (IDRC) with at least one first reference value ($I_{REF}$); and changing a time ($T_{ON\text{-}MAIN}$) needed to reach the maximum value of the current absorbed by the actuator device (20) based on the comparison between the first noise index ($IDRC_i$) and the first reference value ($I_{REF}$), namely decreasing said time ($T_{ON\text{-}MAIN}$) needed to reach the maximum absorbed current value by a first value ($\Delta t_2$), in case the first noise index (IDRC) exceeds the respective first reference value ($I_{REF}$); or increasing said time ($T_{ON\text{-}MAIN}$) needed to reach the maximum absorbed current value by a second value ($\Delta t_3$), in case the first noise index (IDRC) is smaller than or equal to the respective first reference value ($I_{REF}$); and diagnosing a fault of the actuator device (20), in case said time ($T_{ON\text{-}MAIN}$) needed to reach the maximum absorbed current value exceeds a maximum value ($T_{ON\text{-}MAINmax}$).

2. The method according to claim 1, wherein the actuator device (20) is designed to slow down the movement of a piston (14) moving towards a second limit stop position defined by a fixed closing disc (15); and the sensor (31) is suited to detect the noise generated by the movement of the piston (14);

and comprising the further steps of:

acquiring, by means of the sensor (31), the intensity of a signal (S) generated by the impact of the piston (14) against the fixed closing disc (15);

dividing the signal (S) detected by the sensor (31) into a plurality of listening windows ($CW_i$);

calculating a second noise index ($IDRC_i$) of the signal (S) detected by the sensor (31) for each listening window ($CW_i$);

comparing the maximum value ($IDRC_{MAX}$) of the second noise indexes ($IDRC_i$) with at least one second reference value (IDRR); and changing the times of the actuation profile of the actuator device (20) based on the comparison between the maximum value ($IDRC_{MAX}$) and the second reference value (IDRR).

3. The method according to claim 2 and comprising the further step of:

identifying the listening window (CWi) containing the maximum value ($IDRC_{MAX}$);

changing the times of the actuation profile of the actuator device (20) based on the position of the listening window ($CW_i$) having the maximum value ($IDRC_{MAX}$) in the actuation profile.

4. The method according to claim 3 and comprising the further step of changing a time ($T_{OFF2}$) needed to reduce the speed of the piston (14) by a third value ($\Delta t$) based on the position of the listening window ($CW_i$) having the maximum value ($IDRC_{MAX}$) in the actuation profile.

5. The method according to claim 4 and comprising the further steps of:

increasing said time ($T_{OFF2}$) needed to reduce the speed of the piston (14) by a quantity equal to the third value ($\Delta t$), in case the listening window ($CW_i$) having the maximum value ($IDRC_{MAX}$) in the actuation profile proceeds with a closing command; or decreasing said time ($T_{OFF2}$) needed to reduce the speed of the piston (14) by a quantity equal to the third value ($\Delta t$), in case the listening window ($CW_i$) having the maximum value ($IDRC_{MAX}$) in the actuation profile follows the closing command.

6. The method according to claim 1, wherein the first noise index (IDRC) and the second noise index ($IDRC_i$) may be calculated using the following formula:

$$IDRC = MAXs(t)_{t2}^{t1} - MINs(t)_{t2}^{t1}, \text{ where}$$

IDRC is the noise index in the respective listening window (OW; $CW_i$);

s(t) is the signal detected by the sensor (31); and $t_1$, $t_2$ represents the time instants defining the respective listening window (OW; $CW_i$).

7. The method according to claim 1, wherein the first noise index (IDRC) and the second noise index ($IDRC_i$) may be calculated using the following formula:

$$IDRC = \frac{1}{N}\sum_{t=t_1}^{t_N} |\hat{S}(t)|,$$

where

IDRC is the noise index in the respective listening window (OW; $CW_i$);

$\hat{S}(t)$ is the signal detected by the sensor (31) and filtered in time; and $t_1$, $t_N$ represents the time instants defining the respective listening window (OW; $CW_i$).

8. The method according to claim 1, wherein the first noise index (IDRC) and the second noise index ($IDRC_i$) may be calculated using the following formula:

$$IDRC = \underset{f_0 \le f \le f_1}{\mathrm{MAX}} |\hat{S}(f)|,$$

where

IDRC is the noise index in the respective listening window (OW; $CW_i$);

$\hat{S}(f)$ is the signal detected by the sensor (31) and processed by operating a fast Fourier transform; and $f_0$, $f_i$ represents the ends of the band of frequencies analysed in the signal processed by operating a fast Fourier transform inside the respective listening window (OW; $CW_i$).

9. The method according to claim 1, wherein the first noise index (IDRC) and the second noise index ($IDRC_i$) may be calculated using the following formula:

$$IDRC = \frac{1}{N} \sum_{f=f_1}^{f_N} |\hat{S}(f)|,$$

where

IDRC is the noise index in the respective listening window (OW; $CW_i$);

$\hat{S}(f)$ is the signal processed by operating a fast Fourier transform; and $f_1$, $f_N$ represents the ends of the band of frequencies analysed in the signal processed by operating a fast Fourier transform inside the respective listening window (OW; $CW_i$).

10. The method according to claim 1, wherein the sensor (31) is a microphone sensor (31) facing the actuator device (20).

11. The method according to claim 1, wherein the sensor (31) is a vibration sensor (31) integrated in a body of the actuator device (20).

12. The method according to claim 1, wherein the sensor (31) is a vibration sensor (31) arranged externally on the body of the actuator device (20).

* * * * *